US006913494B2

(12) United States Patent
Ward et al.

(10) Patent No.: US 6,913,494 B2
(45) Date of Patent: Jul. 5, 2005

(54) ELECTRICAL CONNECTOR APPARATUS, METHODS AND ARTICLES OF MANUFACTURE

(75) Inventors: Bobby Gene Ward, King, NC (US); Wolfgang Hoelscher, Stokesdale, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/619,723

(22) Filed: Jul. 15, 2003

(65) Prior Publication Data

US 2004/0132352 A1 Jul. 8, 2004

Related U.S. Application Data

(60) Provisional application No. 60/396,852, filed on Jul. 17, 2002.

(51) Int. Cl.[7] ..... H01R 13/514

(52) U.S. Cl. ..... 439/752; 439/352; 439/587

(58) Field of Search ..... 439/752, 587–589, 439/595, 274–275, 352–357, 701, 744

(56) References Cited

U.S. PATENT DOCUMENTS

| | | | | | |
|---|---|---|---|---|---|
| 5,928,038 | A | * | 7/1999 | Berg et al. | 439/752 |
| 5,964,621 | A | * | 10/1999 | Wolla et al. | 439/595 |
| 6,183,299 | B1 | * | 2/2001 | Ward et al. | 439/595 |
| 6,383,020 | B2 | * | 5/2002 | Taguchi et al. | 439/587 |
| 6,514,098 | B2 | * | 2/2003 | Marpoe et al. | 439/352 |
| 2002/0086575 | A1 | | 7/2002 | Marpoe, Jr. et al. | 439/352 |

FOREIGN PATENT DOCUMENTS

| | | | |
|---|---|---|---|
| EP | 1 168 519 A2 | 1/2002 | H01R/13/436 |

* cited by examiner

*Primary Examiner*—Gary Paumen
*Assistant Examiner*—Edwin A. Leon

(57) ABSTRACT

Electrical connector apparatus is provided having a cap and a plug which can be mated together, each of the cap and plug having a respective terminal position assurance device associated therewith, wherein each of the cap, plug and terminal position assurance devices has a box-like configuration, such that when assembled, the connector has a box-in-box-in-box-in-box construction which assures that mechanical and electrical connections will be maintained in high vibration environments.

11 Claims, 9 Drawing Sheets

ELECTRICAL CONNECTOR APPARATUS, METHODS AND ARTICLES OF MANUFACTURE

This application claims the benefit of U.S. Provisional Application(s) No. 60/396,852, filed Jul. 17, 2002.

FIELD OF THE INVENTION

The present invention relates to an electrical connector apparatus, methods and articles of manufacture. More particularly, the present invention relates to connectors adapted for use in environments where the connector may experience strong environmental forces, e.g., external vibration, as might be encountered when installed in large vehicles, for example, tractors, dump trucks, earth moving machinery, and the like.

BACKGROUND OF THE INVENTION

Electrical connectors are a vital part of many devices and systems. The connectors permit both assembly and repair or upgrade of electrical power and electronic control systems that have become ubiquitous. However, each implementation of an electrical connector has its own unique set of considerations and constraints and there are therefore few, if any, universal solutions. For example, the electrical systems of large pieces of equipment or large vehicles present a particularized set of problems, due largely to physical size, power requirements and the extreme environmental conditions and shock and vibration to which these connectors are exposed.

SUMMARY OF THE INVENTION

The present invention comprises an electrical connector apparatus, methods and articles of manufacture.

In the preferred apparatus embodiments, a plug means, with a generally box-like appearance, is configured to receive at least partially a plug terminal position assurance means having a generally box-like appearance; and a cap means, having a generally box-like appearance, is configured to receive at least partially a cap termination position assurance means having a generally box-like appearance. The plug means and cap means are mated, and thus a mechanical connection is The plug means and cap means are mated, and thus a mechanical connection is made upon mating. If contacts are installed within the plug assembly and cap end housing, an electrical connection between the contacts is made as well.

DETAILED DESCRIPTION OF THE PREFERRED EMBODIMENTS

The present invention comprises an electrical connector apparatus, methods and articles of manufacture. The especially preferred embodiments are useful in environments where the connector may experience strong environmental forces, e.g. external vibration, as might be encountered when the embodiments are installed upon large vehicles, for example, tractors, dump trucks, earth moving machinery, etc.

Various features of the preferred embodiments, e.g. such as TPA-finger-contact locking, face to face TPA contact, plug tongue and rail mating with recesses on TPAs, two dimensional sealing, and box within box construction, are provided to minimize effects of vibration upon the connector and maintain a good degree of position relationship between the contacts.

Figure 1:
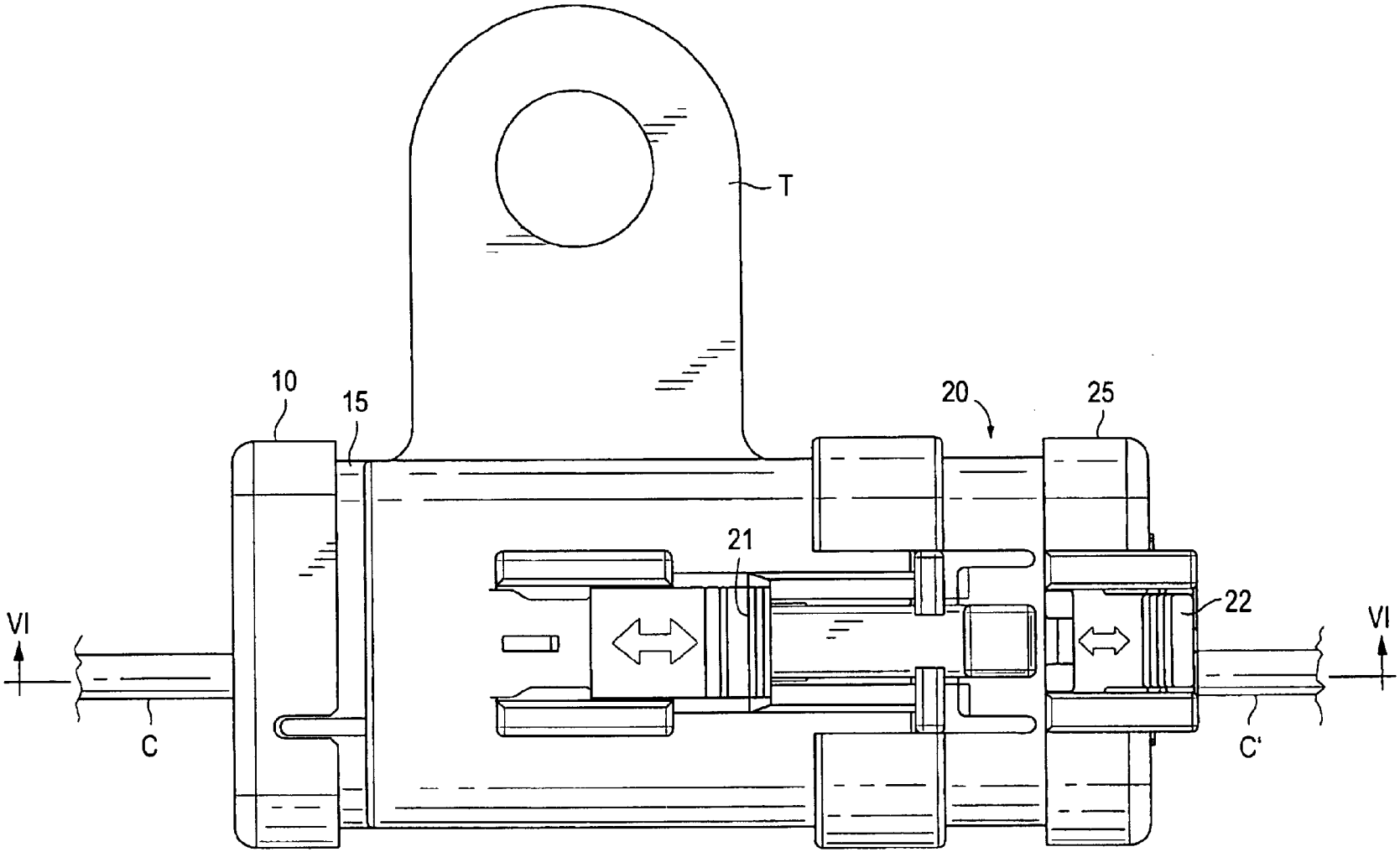
FIG. 1 is a plan view of a preferred embodiment.
Figure 6:
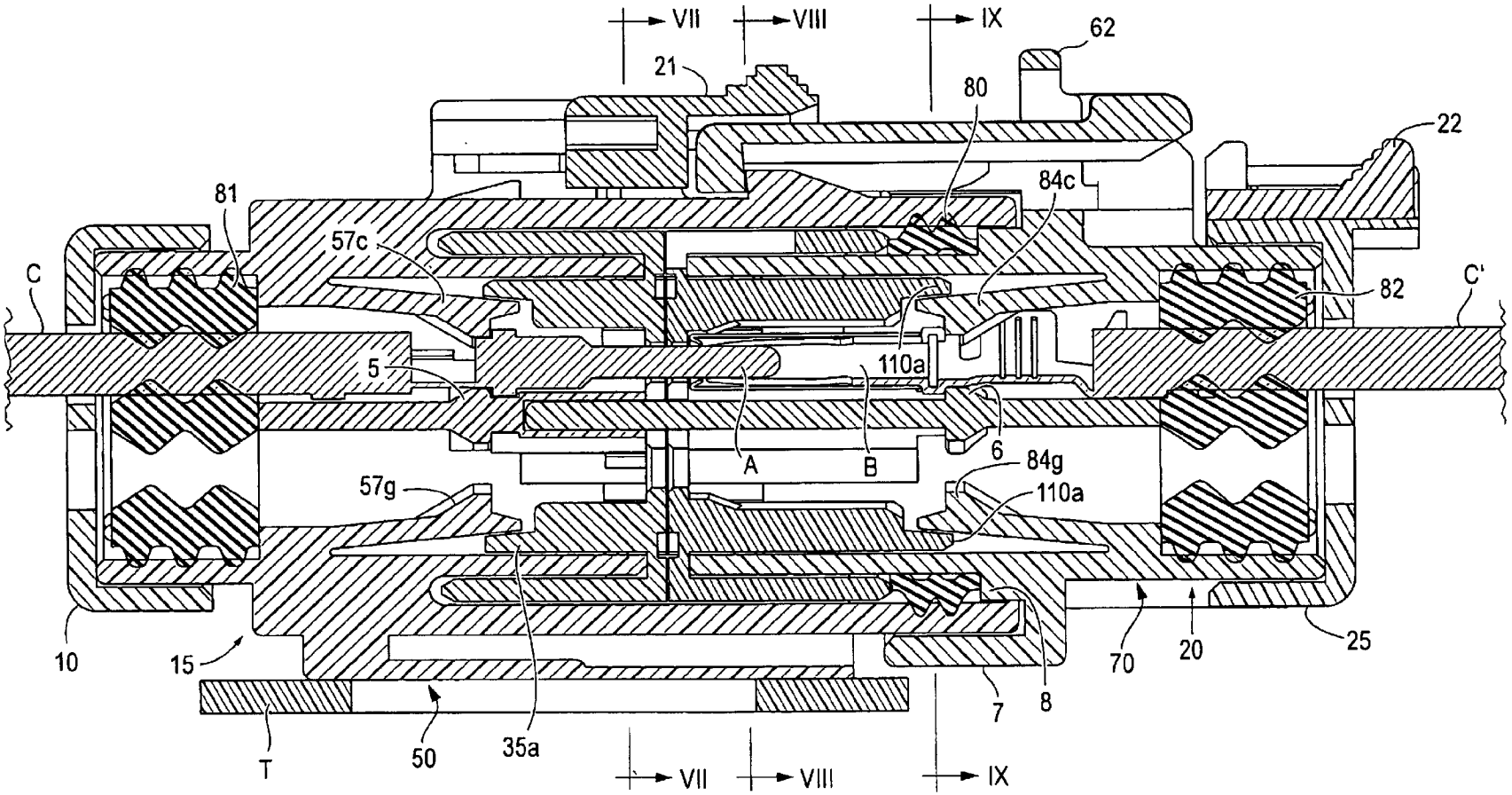
FIG. 6 is a cross-sectional view taken along line VI—VI of FIG. 1.

FIG. 1 shows a plan view of a preferred embodiment. Tab T extends upwardly from the embodiment and is used to mount the embodiment in place. Other mounting means, or none, may be used in other embodiments. Wire C passes through a seal cover 10 into cap end 15 of the connector. Wire C" passes through a seal cover 25 on the plug end 20. The wires are connected through their contacts inside the connector, as can be seen in FIG. 6. Two connector position assurance (CPA) devices 21 and 22 are also seen in FIG. 1, which provide locking contact among their respective components. The CPA devices are optional. In other embodiments, the CPA devices may be omitted or may be employed amongst the various components of that embodiment.

As will be further described below, the internal assembly of the connector of this embodiment comprises a cap end terminal position assurance (TPA) device, a cap housing, a plug TPA and a plug housing, in a series of interlocking, box within box constructions. Tactile and audible feedback is provided when the connector is assembled, so as to ensure positive retention of the internal components and the contacts being connected.

Figure 2:
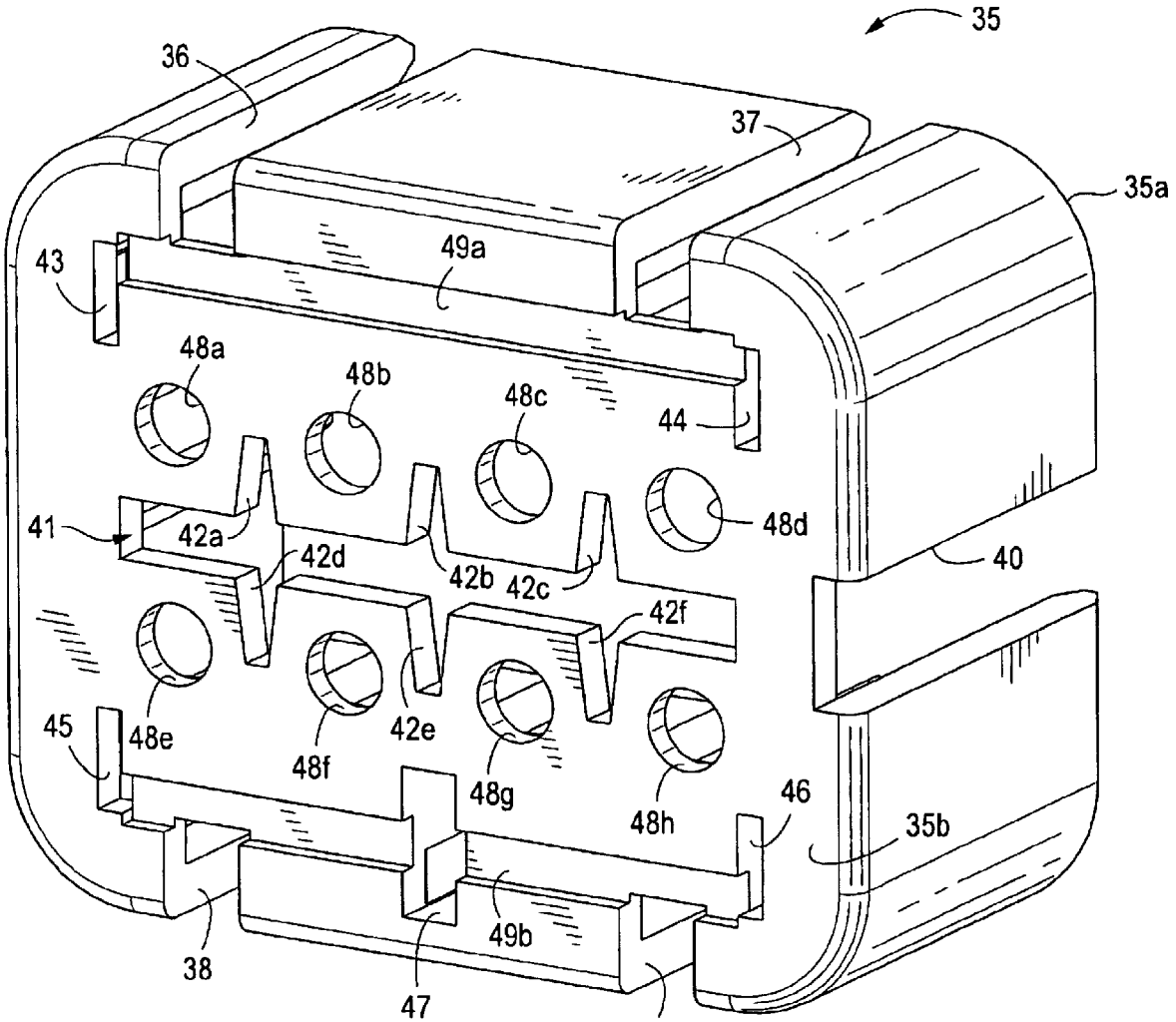
FIG. 2 is a perspective view of the cap TPA from the embodiment of FIG. 1.
Figure 3:
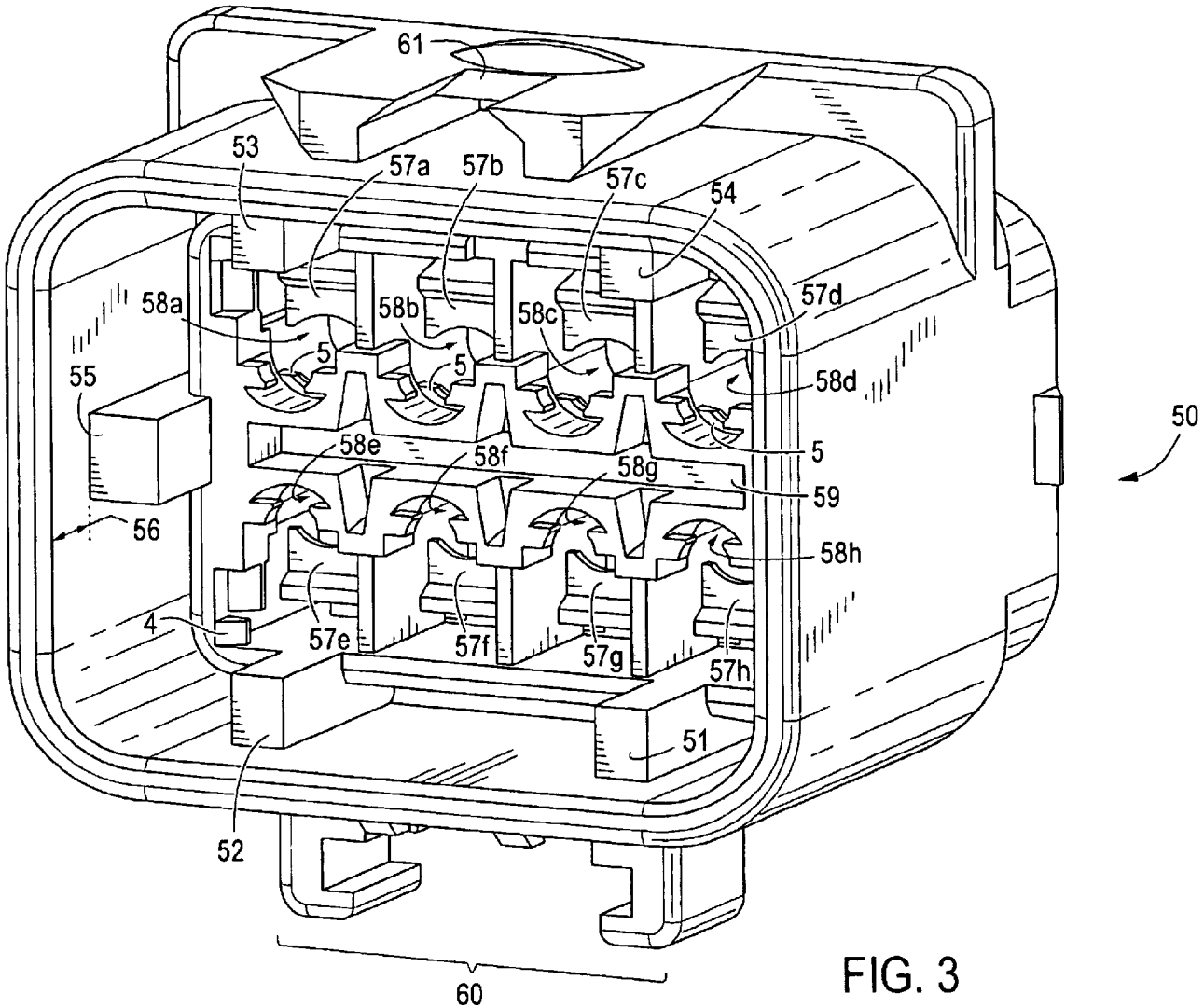
FIG. 3 is a perspective view of the cap from the embodiment of FIG. 1.

Turning now to FIG. 2, a cap end (TPA) device 35 is seen. This TPA mates with the cap housing shown in FIG. 3. Cutaways 36–39 are mated with keys 51–54 on cap housing 50 (seen in FIG. 3). Cutaway 40 mates with rail 55, also on cap housing 50 (FIG. 3). Cutouts 41 and 42*a–f* are mated with corresponding tongue 71 and splines 72*a–f* on plug 70 (seen in FIG. 5). Edge 35*a* provides assistance in locking a pin connector via contact with fingers in cap housing 50, as will be described further below. Face 35*b* will contact a similar face on a plug TPA device 110, as will be described further below.

Slots 43–46 are used to assist in tooling, and slot 47 is used with an appropriate tool to remove the terminal position assurance device from cap housing 50 once installed, as is further described below. Grooves 49*a* and 49*b* provide lateral support to help resist warping of the cap position assurance device 35. Cutouts 48*a–h* provide connector passthrough. As can be seen the cap of this embodiment is used in an eight position connector. Other embodiments may be used with other numbers of positions. Generally, the embodiments shown and described herein are used on double row connectors having four or more positions.

FIG. 3 shows a cap housing 50. Keys 51–54 and rail 55 are shown. Each key stops short of the housing. Thus area 56 is used to insert a seal 80 (FIG. 6) which provides support as well for the interlocking of the components and forces imposed thereon. Pass through for a contact is provided through recesses 58*a–h*.

Fingers 57*a–h* extends into recesses 58*a–h* and are positioned to retain the contacts inserted in the recess. A rib 5 is disposed opposite each of fingers 57*a–h* such that the contacts are clamped between the fingers 57 and the rib 5, as seen in FIG. 6. Recess 59 is shaped so as to receive corresponding tongue 71 and splines 72*a–f* on plug 70 (seen in FIG. 5) as had been described above with regard to FIG. 2. Bracket 60 provides a mating surface for a CPA and bracket 61 provides a mating surface with a mounting tab.

Figure 4:
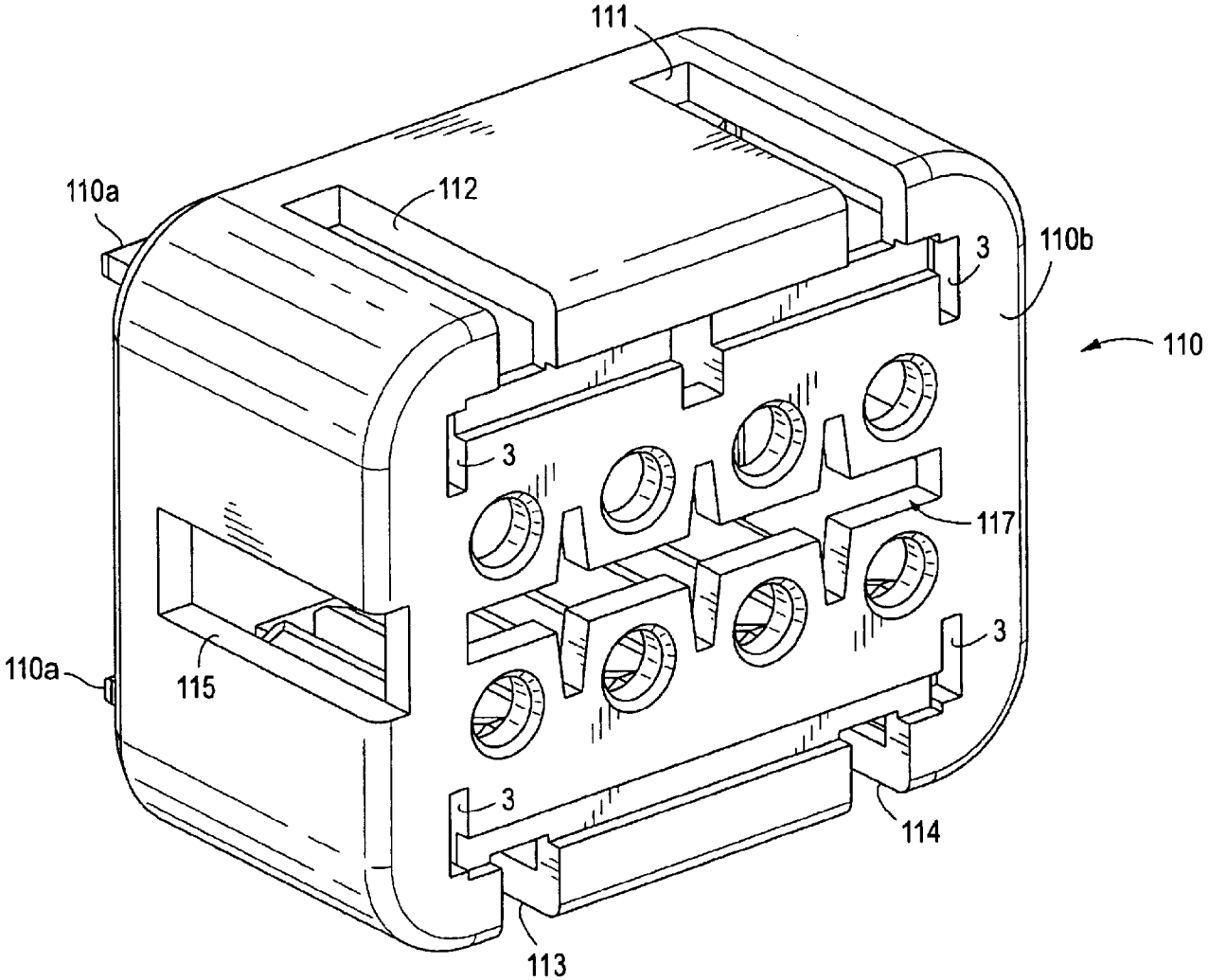
FIG. 4 is a perspective view of the plug TPA from the embodiment of FIG. 1.

FIG. 4 shows a plug TPA device 110. This TPA mates with the plug assembly shown in FIG. 5. Cutaways 111–115 mate with respective keys and rail on cap housing 50 (seen in FIG. 3).

Edge 110*a* provides assistance in locking a socket connector via contact with fingers in plug assembly 70, as will be described further below. Face 110*b* will contact a similar face on a cap end TPA device 35, as will be described further below.

The various cutaways stop short of penetrating through the rear wall of device 110, in order to provide room for seal 80. In other embodiments, with a different shaped or no seal, the cutaways might be shaped differently as well. Of course, in other embodiments of this component and in other embodiments of the components shown in the embodiments of the above figures, recesses might be placed or shaped as desired, so long as they are sufficient to provide sufficient structure to the embodiment.

Also seen in FIG. 4 is recess 117, which is shaped so as to receive tongue 71 and splines 72*a–f* on plug 70 (seen in FIG. 5) as had been described above with regard to FIG. 2. Here too, alternative shapes might be used in other embodiments, so long as sufficient structure is provided.

Figure 5:
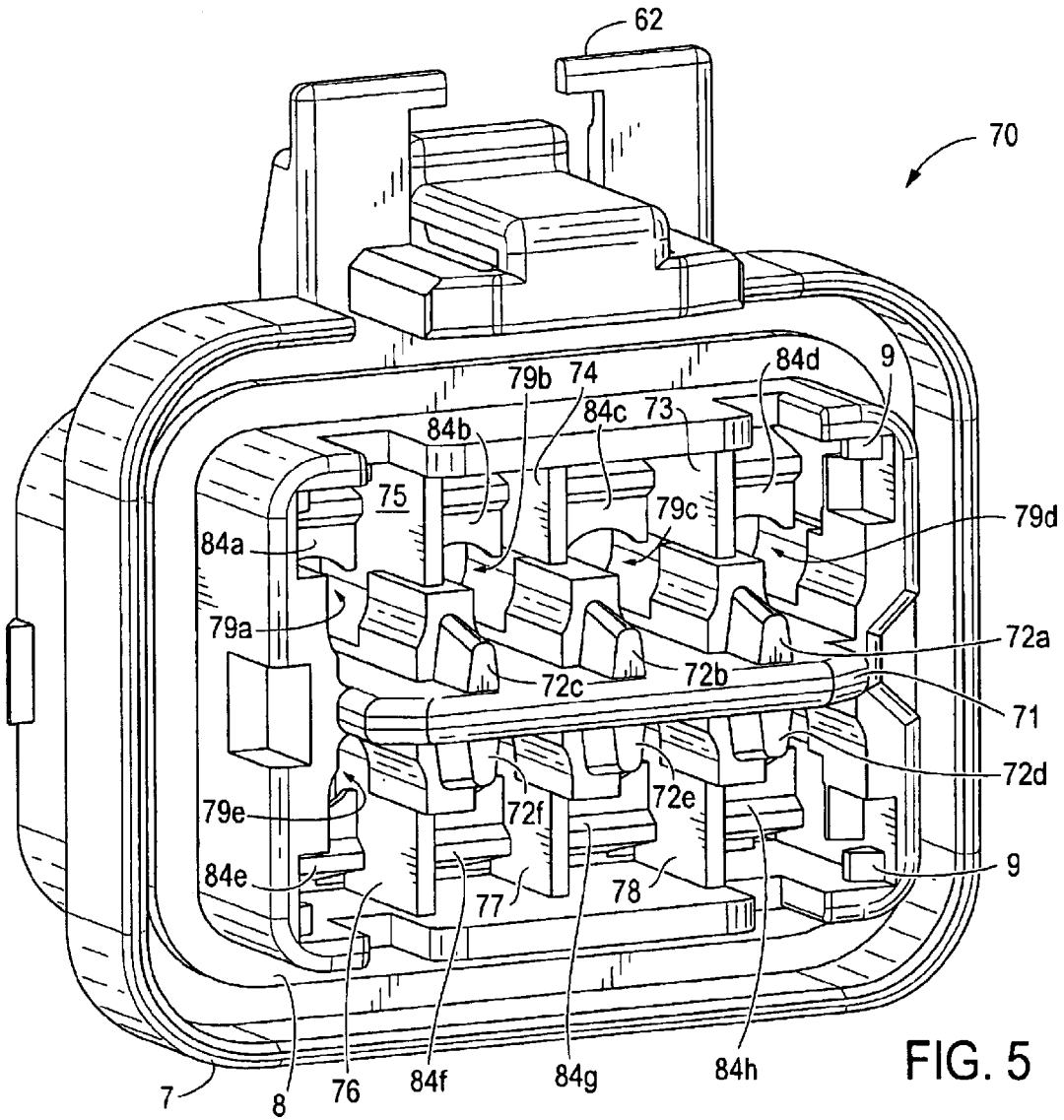
FIG. 5 is a perspective view of the plug from the embodiment of FIG. 1.

Plug assembly 70 shown in FIG. 5 has various recesses 79*a–h* (partially seen) for pass through of the appropriate contacts. Additionally, walls 73–78 provide rigidity to the internal components. Retention fingers 84*a–h* in cooperation with ribs 6 assist in locking the contact in place, and provide locking means for contacts inserted therein, as seen in FIG. 6. Bracket 62 is shown as well, for CPA retention.

Additional retention and support for cap end TPA 35 and plug TPA 110 are provided, as had been described above, through mating with tongue 71 and splines 72*a–f*. For example, central axial support is increased for this embodiment, and the effects of any rotational forces are decreased.

FIG. 6 shows a cross sectional view of the embodiment of FIG. 1, along line VI—VI of FIG. 1. Cap end TPA 35, cap housing 50, plug TPA device 110, and plug assembly 70 are shown in cross section, as well as tab T and engaged CPAs 21 and 22, with an electrical and mechanical connection made between wire or cable C and wire or cable C' via pin A and terminal B. Inner seals 80, 81 and 92, are also shown, as are external seal covers 10 and 25. In the preferred embodiments, inner seals are two dimensional, providing both sealing along the axis of the connector as well as sealing normal to the axis. Of course, in other embodiments, seals may be in a different arrangement, be a different shape, lesser or more seals may be used, no seals may be used, etc.

Pin a is retained in place by the clamping action of finger 57*c* and rib 5 against the contact. TPA 35 has protrusions 35*a* that fit behind the fingers, such as finger 57*c*, to prevent deflection of the finger away from the contact. Thus, upon insertion of TPA 35, the fingers are forced downwardly into a recess in pin A. Similarly, finger 79*c* and rib 6 are shown retaining the terminal B in position. TPA 110 engages the figures via protrusion 110*a* which fit behind the finger 79*c*. Thus, upon the insertion of TPA 110, the fingers are forced downwardly into a recess in terminal B. Other contacts are installed in other recesses in a similar manner, and are retained by fingers in a similar manner. Thus contacts are retained within the connector. When the connector is assembled, TPAs 35 and 110 are in intimate contact with one another along their respective faces 35*b* and 110*b*.

Plug 70 is provided with small, two-stage detents 9, which cooperate with slots 3 in the plug TPA 110 to provide a locking action between the plug TPA 110 and the plug 70. It is understood that in the embodiment shown, the locking detent is a two-stage member, whereby the TPA 110 is retained in a both pre-stage and a final mated stage. One stage detents can be used if desired. Similar detents 4 are provided on the cap 50 and cooperate with slots 45 in the cap TPA 35 to provide similar locking action.

Figure 7:
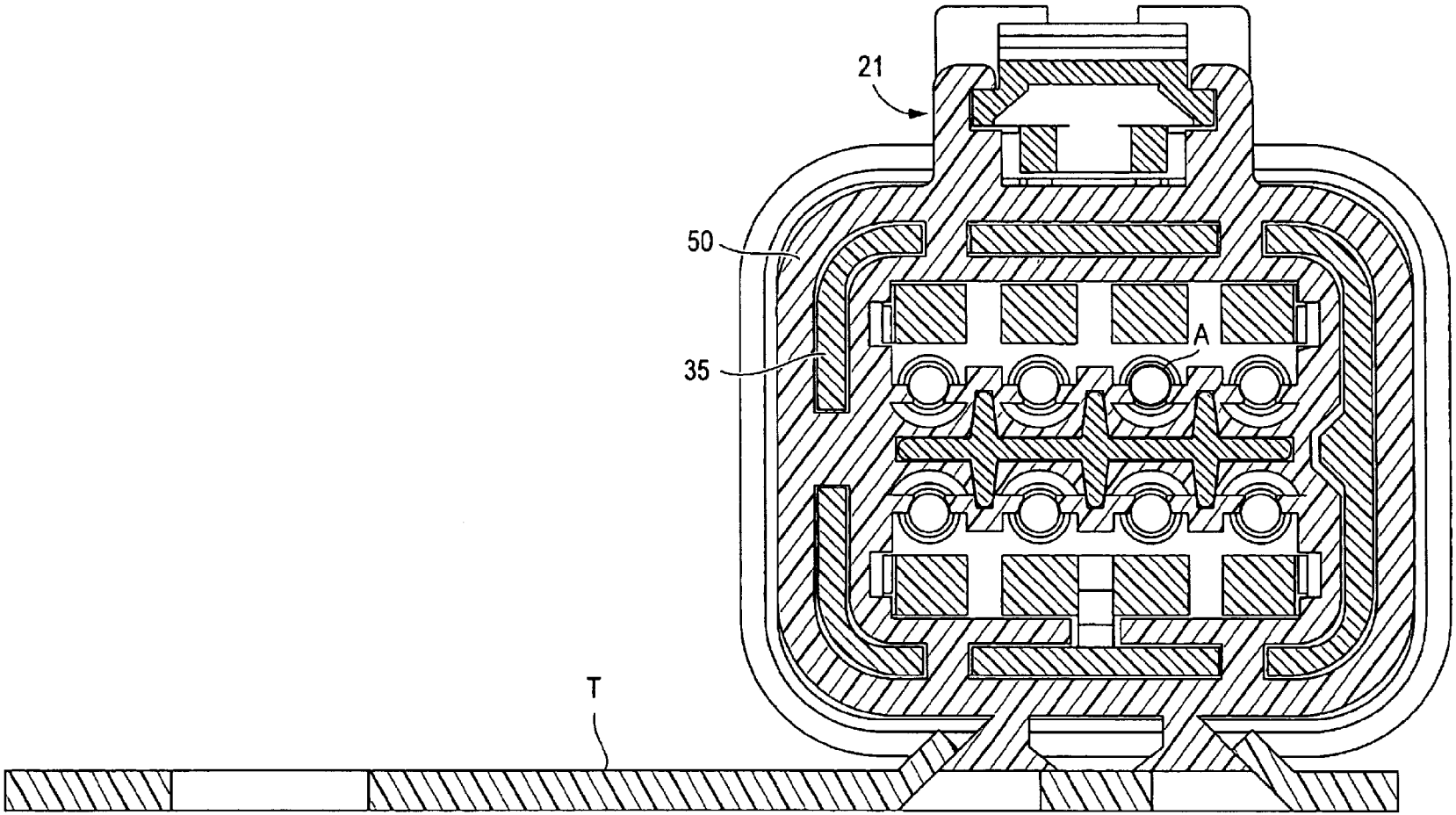
FIG. 7 is a cross-sectional view taken along line VII—VII of FIG. 6.
Figure 8:
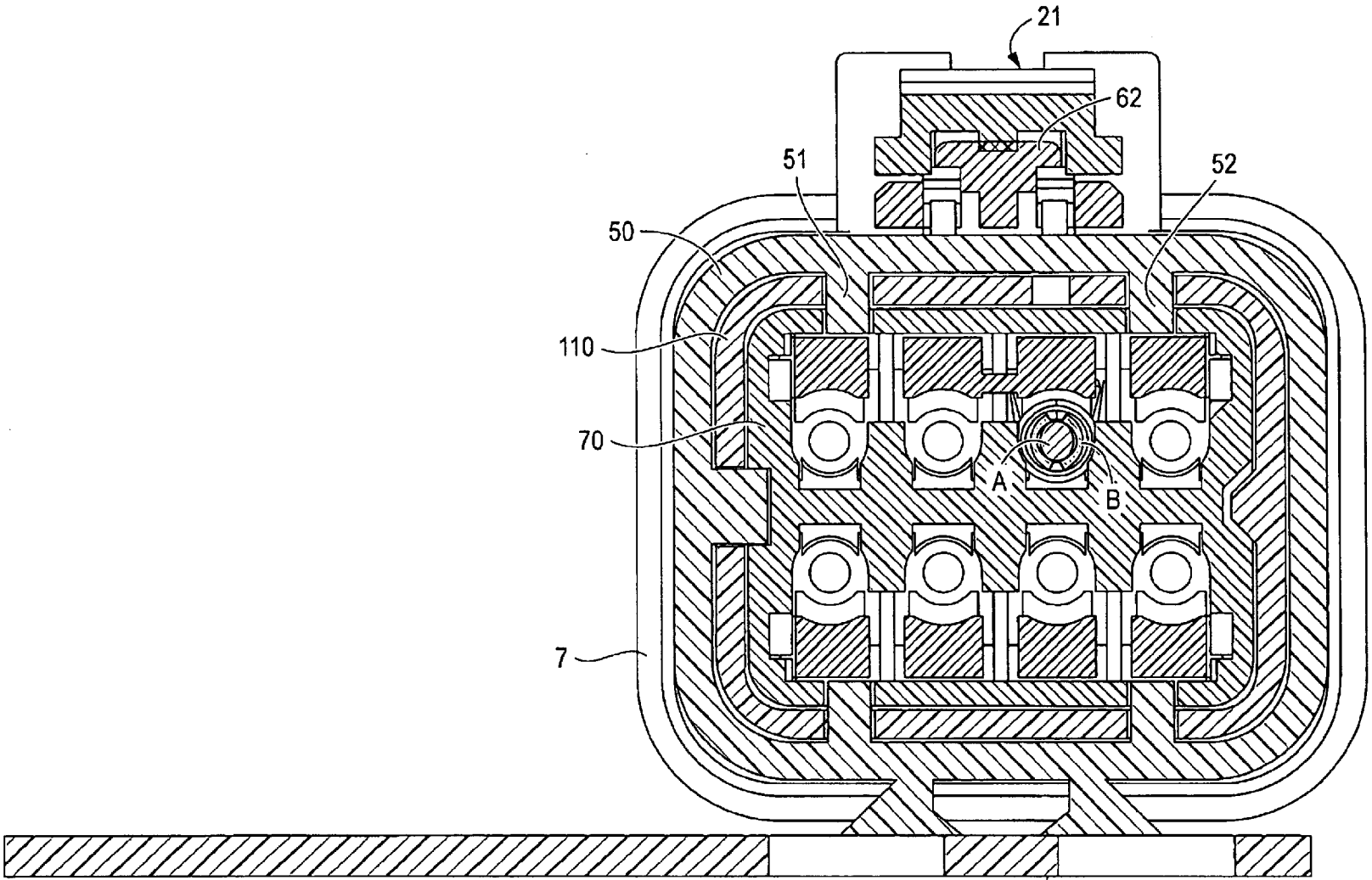
FIG. 8 is a cross-sectional view taken along line VIII—VIII of FIG. 6.
Figure 9:
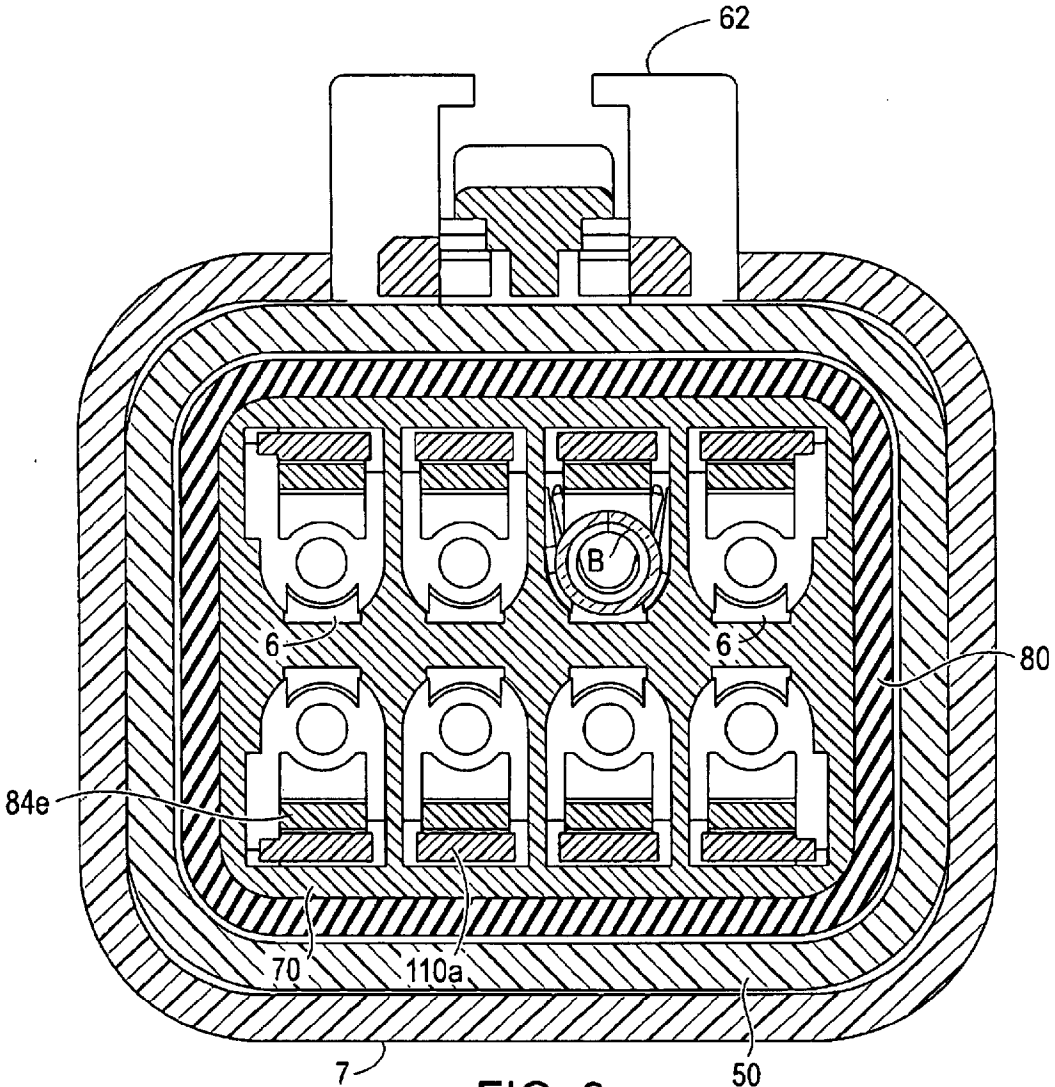
FIG. 9 is a cross-sectional view taken along lines IX—IX of FIG. 6.

FIGS. 7–9 arc cross-sectional views of the assembled connector shown in FIG. 6. As can be seen by these views, the embodiment has a series of "box within box" constructions, thus providing structural strength. For example, plug 70 has a generally box-like appearance, with four continuous walls and a first open end and partial web across a second end and is configured to receive at least partially the plug TPA 110 which also has a generally box-like appearance with a four continuous walls and a first open end and partial web across a second end. Similarly, cap housing 50, has a generally box-like appearance, with four continuous walls and a first open end and partial web across a second end and is configured to receive at least partially cap end TPA 35 having a generally box-like appearance, with four continuous walls and a first open end and partial web across the second end. By this construction, contacts have a greater likelihood of remaining in contact, assisted as well by the locking fingers described above, and the face to face contact of the TPAs. Moreover, internal vibrations are lessened throughout the embodiment through the interlocking construction, particularly the overlapping configuration of shroud 7 on plug 70. As seen in FIGS. 5 and 6, shroud 7 extends beyond a wall 8 of the plug. The space between the shroud 7 and inner wall 8 receives the mating edge of cap 50. As seen in FIG. 6, the shroud 7 serves to lock the cap 50, plug 70 and their respective TPAs 35 and 110 together. This construction enables the connector to withstand significant vibration forces.

The preferred embodiments are molded of 15% glass filled polymer, although other similarly suitable materials may be used in other embodiments. For example, the percentage may be other than 15%, etc.

The above description and the views and material depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

We claim:

1. An apparatus for connecting electrical components comprising;

a) a plug having a generally box-like configuration;

b) a plug terminal position assurance element having a generally box-like configuration, said plug terminal position assurance element being structured to fit at least partially within said plug;

c) a cap having a generally box-like configuration; and d) a cap terminal position assurance element having a generally box-like configuration, said cap terminal position assurance element being structured to fit at least partially within said cap;

e) wherein, when the plug is mated to the cap, the plug, the cap, the plug terminal position assurance element and the cap terminal position assurance element interlock to form a box-inbox-in-box-in-box construction, wherein said plug terminal position assurance element comprises cutaways which mate with at least one corresponding key and at least one corresponding rail on the cap.

2. The apparatus of claim 1, wherein said plug means comprises cutaways which mate with said at least one corresponding key and said at least one corresponding rail on said cap.

3. The apparatus of claim 1, wherein said plug further comprises a detent which cooperates with a slot on the plug terminal position assurance element to retain said plug terminal position assurance element in position.

4. The apparatus of claim 3, wherein said detent comprises a two stage detent.

5. The apparatus of claim 1, wherein said cap further comprises a detent which cooperates with a slot on the cap terminal position assurance element to retain said cap terminal position assurance element in position.

6. The apparatus of claim 5 wherein said detent comprises a two stage detent.

7. An apparatus for connecting electrical components comprising:

a) a plug having a generally box-like configuration, said plug comprising at least one cavity adapted to receive and retain an electrical terminal therein, said at least one cavity comprising a deflectable locking finger and a rib which cooperate to retain the electrical terminal in the cavity;

b) a plug terminal position assurance element having a generally box-like configuration, said plug terminal position assurance element being structured to fit at least partially within said plug;

c) a cap having a generally box-like configuration;

d) a cap terminal position assurance element having a generally box-like configuration, said cap terminal position assurance element being structured to fit at least partially within said cap;

e) wherein, when the plug is mated to the cap, the plug, the cap, the plug terminal position assurance element and the cap terminal position assurance element interlock to form a box-in-box-in-box-in-box construction, wherein one of the plug and cap terminal position assurance elements comprise a projection that contacts the deflectable finger to prevent the deflectable finger from deflecting.

8. The apparatus of claim 7, wherein the cap terminal position assurance element comprises the projection that contacts the deflectable finger to prevent the deflectable finger from deflecting.

9. The apparatus of claim 7, wherein the plug terminal position assurance element comprises the projection that contacts the deflectable finger to prevent the deflectable finger from deflecting.

10. An apparatus for connecting electrical components comprising:

a) a plug having a generally box-like configuration;

b) a plug terminal position assurance-element having a generally box-like configuration, said plug terminal position assurance element being structured to fit at least partially within said plug, said plug further comprising a detent which cooperates with a slot on the plug terminal position assurance element to retain said plug terminal position assurance-element in position;

c) a cap having a generally box-like configuration, said cap further comprising a detent which cooperates with a slot on the cap terminal position assurance element to retain said cap terminal position assurance element in position, at least one of said detent of said plug and said detent of said cap comprising a two stage detent;

d) a cap terminal position assurance element having a generally box-like configuration, said cap terminal position assurance element being structured to fit at least partially within said cap;

e) wherein, when the plug is mated to the cap, the plug, the cap, the plug terminal position assurance element and the cap terminal position assurance-element interlock to form a box-in-box-in-box-in-box construction.

11. An apparatus for connecting electrical components comprising:

a) a plug having a generally box-like configuration;

b) a plug terminal position assurance element having a generally box-like configuration, said plug terminal position assurance element being structured to fit at least partially within said plug;

c) a cap having a generally box-like configuration;

d) a cap terminal position assurance element having a generally box-like configuration, said cap terminal position assurance element being structured to fit at least partially within said cap, said cap terminal position assurance element comprising cutaways that mate with at least one corresponding key and at least one corresponding rail on said cap;

e) wherein, when the plug is mated to the cap, the plug, the cap, the plug terminal position assurance element and the cap terminal position assurance element interlock to form a box-in-box-in-box-in-box construction.

* * * * *